US005078633A

United States Patent [19]

Tolbert, Jr.

[11] Patent Number: 5,078,633

[45] Date of Patent: Jan. 7, 1992

[54] WATER SPORT FOOTWEAR

[76] Inventor: James H. Tolbert, Jr., 6220 Ackel St., #446, Metairie, La. 70003

[21] Appl. No.: 324,732

[22] Filed: Mar. 17, 1989

Related U.S. Application Data

[63] Continuation-in-part of Ser. No. 784,577, Oct. 4, 1985, abandoned.

[51] Int. Cl.[5] ..... B63B 35/81

[52] U.S. Cl. ..... 441/65; 36/114

[58] Field of Search ..... 441/65, 68, 76, 77, 441/79, 61, 70; D21/229; 36/50, 30 R, 114, 115, 117; 280/600, 601

[56] References Cited

U.S. PATENT DOCUMENTS

| | | | |
|---|---|---|---|
| 1,983,609 | 12/1934 | Hudson | 441/61 |
| 3,378,275 | 4/1968 | Rockwood et al. | 441/68 |
| 3,428,979 | 2/1969 | Johnson | 441/68 |
| 3,879,047 | 4/1975 | MacDonald | 280/600 X |
| 3,918,114 | 11/1975 | Schmitt | 441/68 |
| 4,227,274 | 10/1980 | Richardson | 441/68 |
| 4,366,634 | 1/1983 | Giese | 36/114 |
| 4,455,765 | 6/1984 | Sjosward | 36/30 R |
| 4,463,505 | 8/1984 | Duclos | 36/30 R |

*Primary Examiner*—Sherman Basinger
*Attorney, Agent, or Firm*—Keaty & Keaty

[57] ABSTRACT

The invention relates to water sport footwear designed for placing on a foot of a wearer during gliding on the surface of water, with the bottom of the shoe sole contacting the water during the gliding process. The shoe includes a boot portion and a sole portion fixedly attached to the boot portion, while the sole portion is not considerably greater than the boot portion itself. A water channel is formed in the bottom of the sole portion, the channel extending from the heel portion to a distance towards the front portion. The sole has a composite base structure having a rigid upper plate and a softer, flexible bottom part integrally attached to each other. Alternatively, the bottom of the sole portion can be provided with a pair of channels equidistantly spaced on the opposite sides of the central water channel for increased control and maneuverability.

1 Claim, 5 Drawing Sheets

WATER SPORT FOOTWEAR

CROSS REFERENCE TO RELATED APPLICATIONS

This application is a continuation-in-part application of my co-pending application Ser. No. 784,577 of the patent application filed Oct. 4, 1985 for "Water Ski Shoes", the disclosure of which is incorporated herewith by reference.

BACKGROUND OF THE INVENTION

The present invention relates to footwear for water sports, and more specifically to footwear worn during gliding on the body of water, while the user is being pulled along the body of water by a motor boat or the like.

In the recent years, it has become popular to engage in barefoot water skiing, which presents considerable danger to the feet of the skier. In barefoot water skiing, a sportsman holds by hands onto a pulling rope, while contacting the surface of water with his bare feet, and is being propelled about the surface of water at considerable speed. Various mechanical objects in the body of water, such as wooden splinters, pieces of plastic containers and the like which float in the body of water can damage the feet of the sportsman, causing serious injuries.

There are also known various elongated skis in which conventional water ski shoes of the sportsman are secured by clamps or similar means which allow the sportsman to engage in conventional water skiing sports. But, as with barefoot skiing, there is present a danger of injury to a sportsman, such as when a sportsman falls, the ski may become the damaging object, causing injury to the sportsman, breaking and leaving the broken pieces on the surface of water, so that the next skier is injured by the broken skis. There are also known special skie shoes which are worn by a skier performing stunts at water variety shows which conventionally are worn by the skiers and are adapted for securing in the clamp of a water ski and adapted to be easily disengaged from the water ski when required. Such example is shown in USSR Author's Certificate No. 925,359 issued on May 7, 1982 and entitled "Water Skier Towing Mechanism". The water ski footwear in accordance with '359 Author's Certificate is designed for engaging the towing cable through a special catch hook arrangement in the sole of the shoe, so as to liberate the hands of the skier while he is being pulled by his foot and allow him to support a partner and perform various stunts, while the shoe is raised above the body of water and the skier continues gliding on the surface of water with his other foot, which is engaged by a conventional water ski.

It is an object of the present invention to overcome deficiencies of the prior art and provide a safe alternative to barefoot skiing, allowing the user to glide on the body of water while wearing the footwear without the assistance of water skis.

It is a further object of the present invention to provide a water sport footwear which has improved hydrodynamic qualities.

It is a further object of the present invention to provide a water sport footwear which protects the foot of the sportsman, as it comes in contact with the body of water during gliding on the surface of the water.

These and other objects of the present invention will be more apparent to those skilled in the art from the following description of the invention.

SUMMARY OF THE INVENTION

The present invention achieves its objects and overcomes deficiencies of the prior art in a simple and straightforward manner. The present invention contemplates provision of a water sport footwear which comprises a sole portion and a boot portion fixedly attached to the sole portion, while the sole portion is not considerably greater than the boot portion itself. The bottom surface of the sole portion immediately contacts the body of water during entire water gliding by a sportsman, without the assistance of water skis, supporting the skier's foot and engaging it, while extending upwardly to a distance adjacent an ankle of the sportsman. The boot portion is sized and shaped to follow natural size and shape of the sportsman's foot so as to provide comfortable protection to the sportsman's foot without bulky support means, such as conventional water skis. The sole portion provides improved stability and hydrodynamic qualities. A water channel is formed in the bottom of the sole portion, the channel extending from the heel portion to a distance from the front portion gradually reducing in depth towards its innermost end.

The apparatus further provides a composite base portion, including an upper polyurethane plate secured to the shoe portion along its upper surface, and including a pair of curved forward and rearward mounting walls further secured to the toe and heel of the shoe via stitching or the like, the polyurethane plate substantially oval shaped and extending a slight distance beyond the outer shape of the shoe, for defining the base of the ski shoe. The composite base further includes a soft and flexible bottom plate secured to the underside of the polyurethane plate, for making contact with the water, the bottom plate including a water channel along the rear half of the shoe for providing improved control and maneuverability during water skiing. In an additional embodiment, there may be further included a pair of channels in the soft and flexible bottom layer, along the front half of the shoe for providing improved control and maneuverability while skiing in the reversed position.

The sole has upwardly curved front and heel portions, with the front portion being curved upwardly to a greater degree than the heel portion. An upwardly turned arch portion further enhances comfort of using the water sport footwear in gliding on the water surface. The boot portion can be secured on the sportsman's feet by boot laces and/or securing straps.

BRIEF DESCRIPTION OF THE PREFERRED EMBODIMENTS

Figure 1:
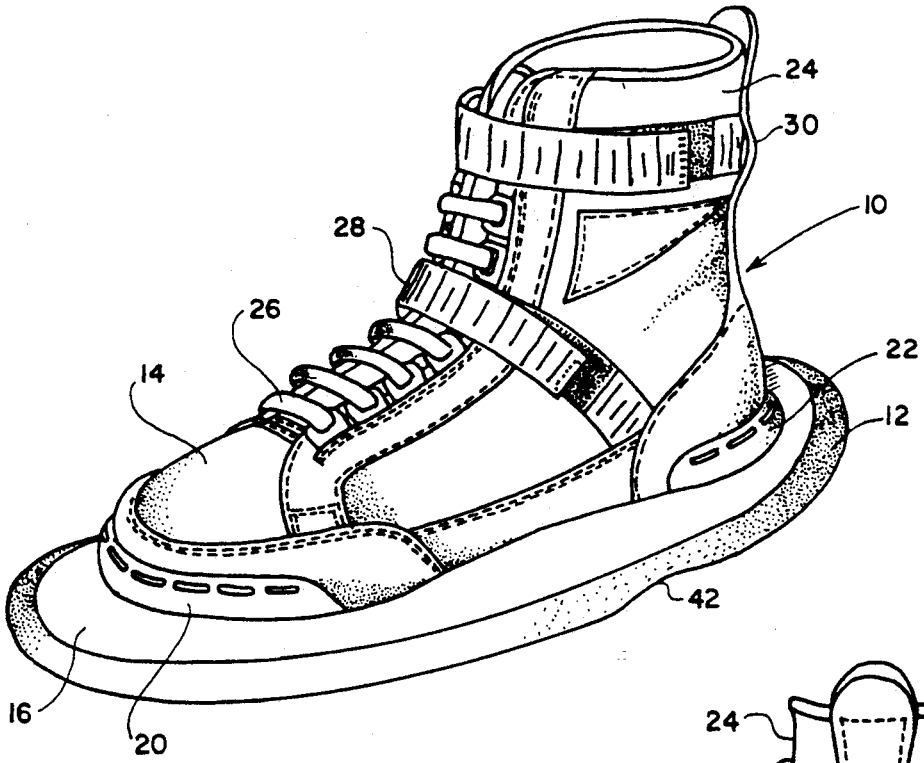
FIG. 1 is a perspective view of one of the embodiments of the water sport footwear in accordance with the present invention.
Figure 2:
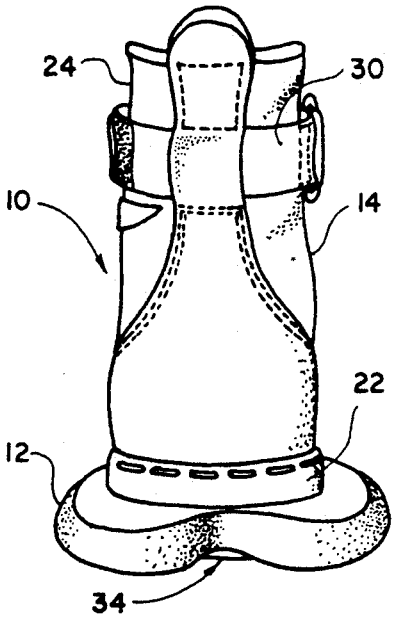
FIG. 2 is a rear view of an alternative embodiment of the footwear in accordance with the present invention.
Figure 3:
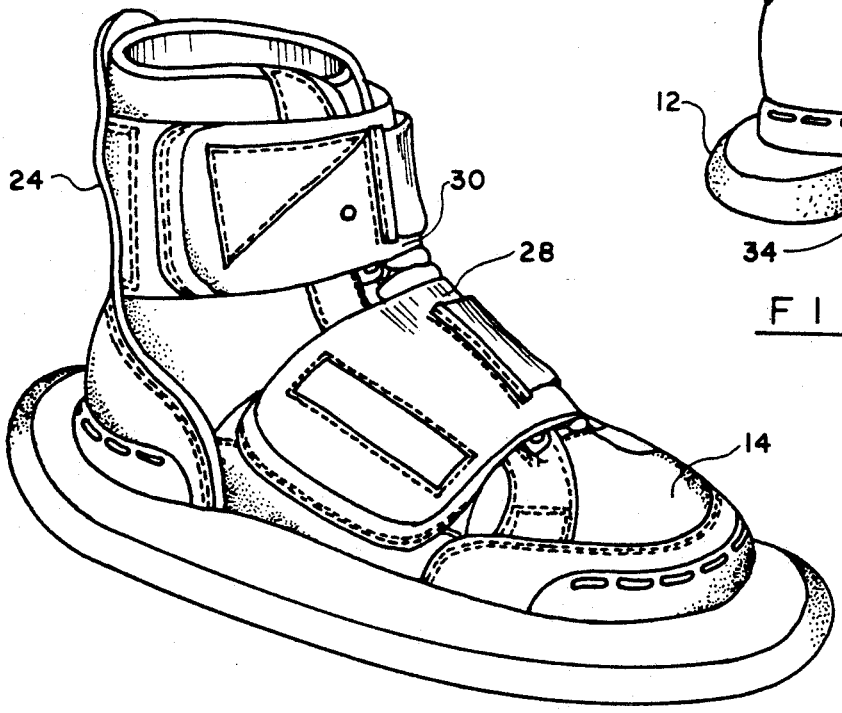
FIG. 3 is a perspective view of an alternative embodiment of the footwear in accordance with the present invention.

Reference will now be made to the drawings, and more specifically to FIGS. 1-5 wherein like numerals designate like parts and wherein a water sport footwear in accordance with the present invention is designated generally by numeral 10.

The water sport footwear 10 comprises a sole, or platform portion 12 and a boot, or shoe portion 14 which is fixedly attached to the sole portion 12 by glue or other similar methods.

The size of the sole portion 12 is not considerably greater than the size of the boot portion 14, which rests on a top surface 16 of the sole portion 12. The bottom surface 18 of the sole portion 12 is designed for gliding on the surface of water during the entire water gliding process, as will be described in more detail hereinafter.

The sole portion 12 is made from a rigid yet deformable (such as polyurethane) lightweight material, so as to afford stability on the water, while preventing injury to the sportsman, should the sole portion become disengaged, under extreme circumstances, from the boot portion 14.

The sole portion 12 is made from two layers fixedly and integrally attached to each other to prevent their disengagement during use of the footwear 10.

Figure 10:
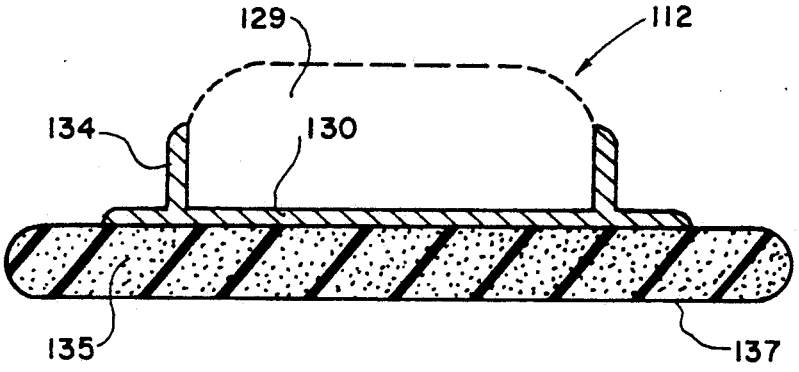
FIG. 10 is a detail cross-sectional view taken along lines 10—10 in FIG. 9.

As can be better seen in FIG. 10, the sole or platform comprises a bottom layer 135 made from a relatively soft flexible material known as E.V.A. and an upper relatively rigid layer 130 formed from, for example, polyurethane. The shoe portion 14 is fixedly secured on top of the upper layer 130, between heel and front protectors 20 and 22. The bottom layer 135 is slightly larger about its entire perimeter than the upper layer 130.

Fixedly attached to the sole portion 12, and more specifically to the top surface 16 thereof, are an arcuate front rigidification (or protection) element, or wall 20 and an arcuate heel, or rear rigidification (or protection) element, or wall 22 which extend substantially vertically from the surface 16 to further enhance protection of the sportsman's foot, as well as provide structural support for securing of the boot portion 14 to the sole portion 12. The elements 20 and 22 are made from a material similar to the material of the sole portion 12 and are curved to follow the general outline of the boot portion 14, forming the front and heel protectors for the shoes, respectively. The protection elements 20 and 22 are fixedly attached to the boot portion 14.

The boot portion 14 generally follows a shape of a human foot and extends with its upper portion 24 to about an ankle of a sportsman. The boot portion 14 is secured on the user's foot by laces 26 (FIG. 1) or through the use of straps 28, 30 (FIGS. 1 and 4), which can be used in combination with the laces 26 or separately. The straps 28 secure the instep part of the boot portion 14, while the straps 30 secure an ankle or upper portion 24 of the footwear 10.

Figure 4:
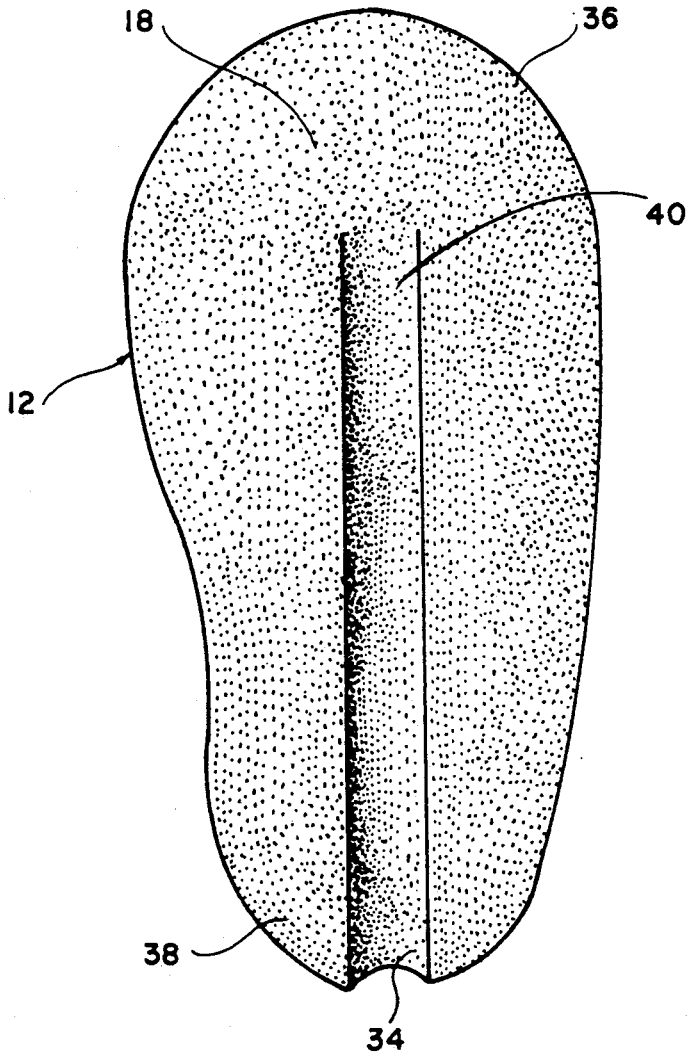
FIG. 4 is a bottom view of the sole of the footwear shown in FIGS. 1–3.

As can be seen in FIGS. 1 and 4, the ankle securing strap 30 can vary in width and may utilize hook and loop fasteners, such as Velcro, or buckle (not shown), if so desired.

Figure 5:
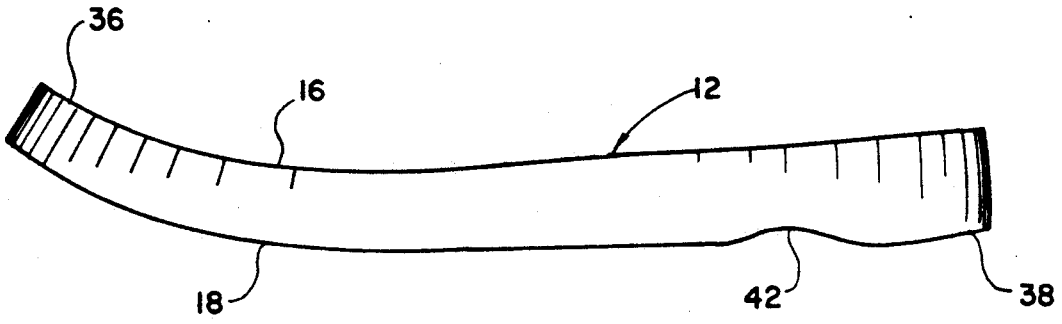
FIG. 5 is a side view of the sole shown in FIG. 4.
Figure 6:
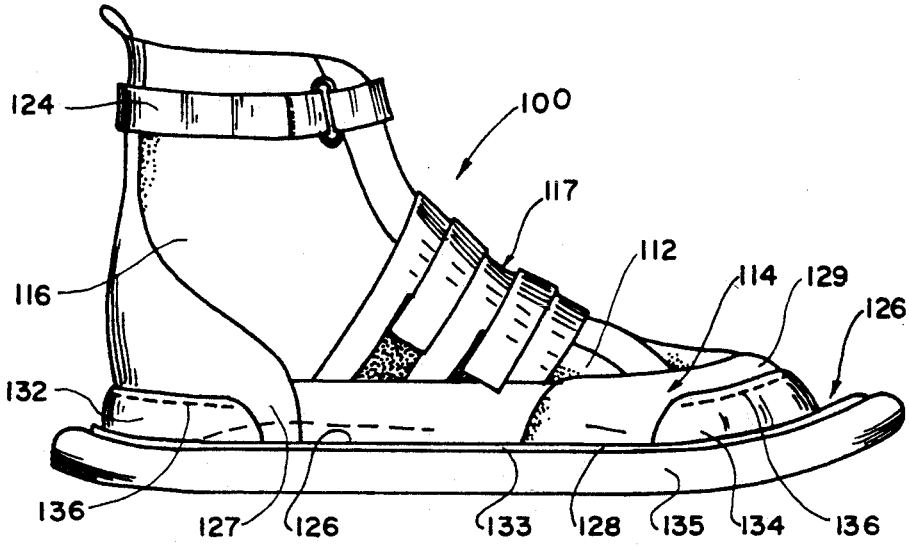
FIG. 6 is a side view of a second embodiment of the present invention.
Figure 7:
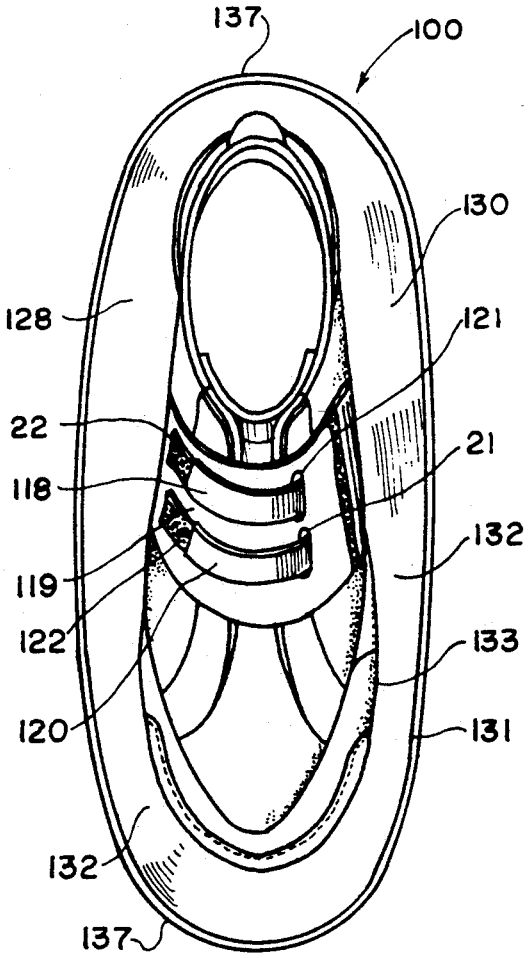
FIG. 7 is a top view of the embodiment shown in FIG. 6.
Figure 8:
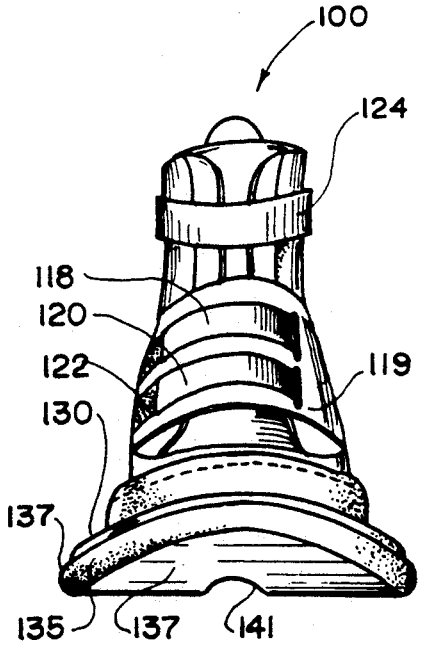
FIG. 8 is a front view of the embodiment shown in FIGS. 6 and 7.

Reference will now be made to FIGS. 4 and 5, illustrating the sole of the footwear in accordance with the present invention.

The sole 12, as was discussed above has an upper surface 16 and a bottom surface 18. The bottom surface 18 is provided with a substantially arcuate water channel 34 which extends from the heel portion 38, inwardly towards the front portion 36 and terminates a distance from the front portion 36 of the sole 12. The depth of the channel 34 generally decreases from the heel part 38 towards its innermost end 40, so that channel 34 gradually meets with the bottom surface 18 at its innermost end.

The front 36 and the heel 38 portions are curved so as to offer less resistance to a water flow and create less turbulence, while the bottom surface 18 contacts the body of water during water gliding process.

As can be seen in FIG. 5, the front portion 36 is curved upwardly to a degree substantially greater than the heel portion 38, wherein the upward curvature is not so pronounced. Forming a part of the sole portion 12 is an upwardly curved arch part 42 which is formed adjacent the heel portion 38 in the area of a human foot arch to generally follow natural shape of the human foot and make the footwear 10 more comfortable in use. As has been demonstrated by numerous tests, such multi-curved shape of the sole portion 12 provides for improved stability of the footwear 10 on water, as well as provides improved hydrodynamic qualities to the water gliding process in addition to offering greater comfort to the user.

It should be noted that the size of the water sport footwear 10 can vary, depending on the actual size of a sportsman's foot who uses the footwear in accordance with the present invention. Still, the proportions between the boot portion 14 and sole portion 12 are retained, so as to allow more freedom of movement for the user of the water sport footwear 10, while not restraining his movement, and giving the illusion of "barefoot skiing" with the protection to the foot that sport cannot provide. The footwear shape is slightly different for a left and a right foot, generally following the natural shape of human feet.

In operation, a sportsman secures the boot portion 14 about his foot, tightening the laces 26 and securing straps 28 and 30, when necessary, so as to completely cover his foot and the ankle, thus preventing accidental removal of the footwear during water gliding process. A conventional propelling means, such as a water boat, is employed for towing and propelling the sportsman, when he starts the water gliding process by placing his feet with bottom surface 18 on the surface of water, thus starting the gliding process in the footwear itself, without the use of water ski shoes and/or water skis of any kind. During the entire water gliding process, the water sport footwear 10 is secured on the foot of the sportsman, allowing him to perform various stunts, if desired, while not restricting his movements to any degree, which advantage cannot be afforded by any conventional footwear presently known to the applicant.

As will be appreciated, the boot portion 14 can vary in design, size, color or the material from which it is made. Some of the applications contemplate the use of water impermeable material for the boot portion 14, while other applications utilize, at least in part, water permeable materials for the boot portion 14. The sole portion 12 is made from substantially rigid plastic which retains its shape during impact with the surface of water, does not easily deform, but still allows formation of various required curvatures in the shape of the sole.

Reference will now be made to FIGS. 6–12 in illustrating the second embodiment of the apparatus of the present invention designated by the numeral 100. As illustrated, the footwear apparatus 10 comprises an upper shoe portion 112 which is constructed of a flexible material, such as canvass or the like, of double strength, or double layered special cloth, which would be durable, water resistant and easy to care for. Shoe portion 112 includes a lower foot portion 114, and an upper ankle portion 116, which can be of various sizes for accommodating various sizes of feet. Shoe 112 accommodates the foot of the person and with the foot of the person completely enveloped within shoe portion 112 and held in place by a series of adjustable flexible securing means having for example hook-and-loop type fasteners, such as Velcro® straps 117 along the lower foot portion which include a first wide strap 119, with a pair of narrow straps 118 and 120 threaded through ports 121 in strap 119, which all three straps 118, 119, and 120 being held in place via Velcro attachments 122. To further secure the shoe in place, there is further included an upper strap member 124 which encircles the upper portion 16 of shoe 12, for securing the ankle in place to resist twisting or turning of the ankle during the water sport.

As further seen in the drawings, shoe 112 includes a lower bottom surface 126, permanently secured to a platform means 128. Platform means 128 includes an upper polyurethane base plate 130, which is somewhat rigid in its construction, and is utilized for support and control in securing the upper shoe portion 112 in place. Plate 130 includes a rear arcuate support wall or heel element 132 encompassing the heel 127 of shoe 112, and a forward arcuate support wall or protector 134 encompassing the toe 129 of shoe 112, each of the walls 132 and 134 further secured to shoe 112 via stitching 136 along their upper edge to prevent any possible shifting of the shoe along the platform 30 during use. Shoe 112 is secured along its bottom surface 126 to rigid polyurethane plate 130 so that shoe 112 is integrally attached thereto in the composite format.

Platform 128 includes a perimeter portion 132 extending a distance outward from the outer edge of shoe 112, the distance being somewhat proportional to the overall size of the shoe and extending therefrom approximately 2 to 5 centimeters outwardly from the shoe between the outer edge 113 of the shoe and the outer edge 131 of the plate in all directions, so that plate 130 defines in effect an oval platform upon which shoe 112 is securely positioned.

Support platform 130 includes a lower surface 133 secured along its entire undersurface to a lower, soft and flexible material 135 known as E.V.A., which defines the surface upon which the footwear 10 glides upon the surface of the water during water skiing. The undersurface material 135 as secured to the upper support portion 130 can be of a dimension slightly larger than the overall width and length of upper support surface 130 and defines an outer perimeter edge 137 extending outwardly from the outer edge 131 of support portion 130, for defining a cushion to help absorb impacts between the ski shoe and objects, which would further resist in the tearing or breaking of rigid support surface 130 during use.

Figure 11:
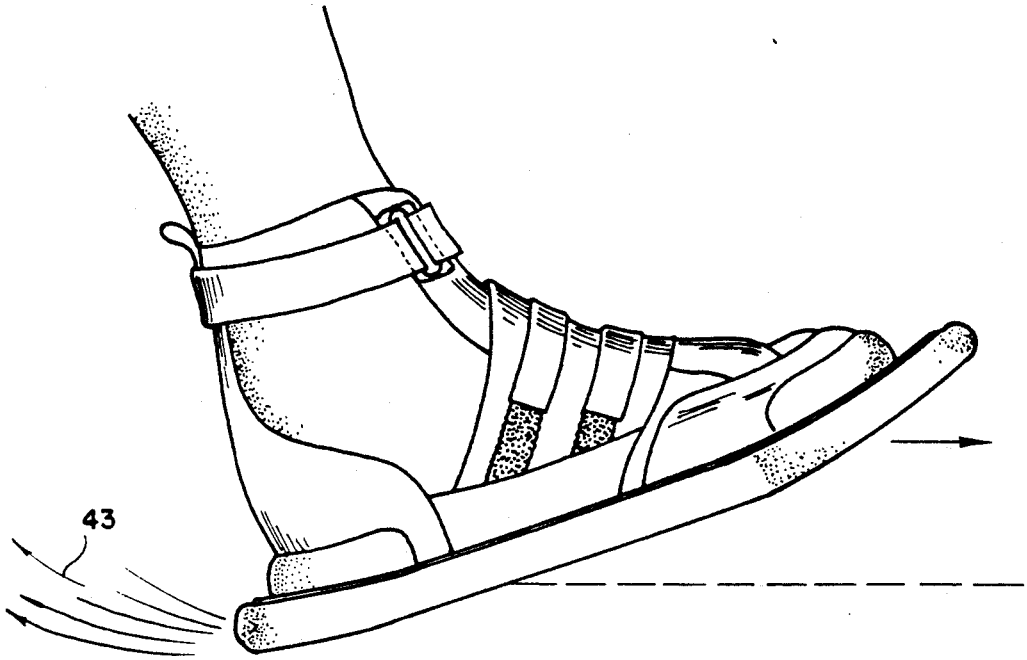
FIG. 11 is a view similar to the view of FIG. 9 illustrating the footwear in use.
Figure 12:
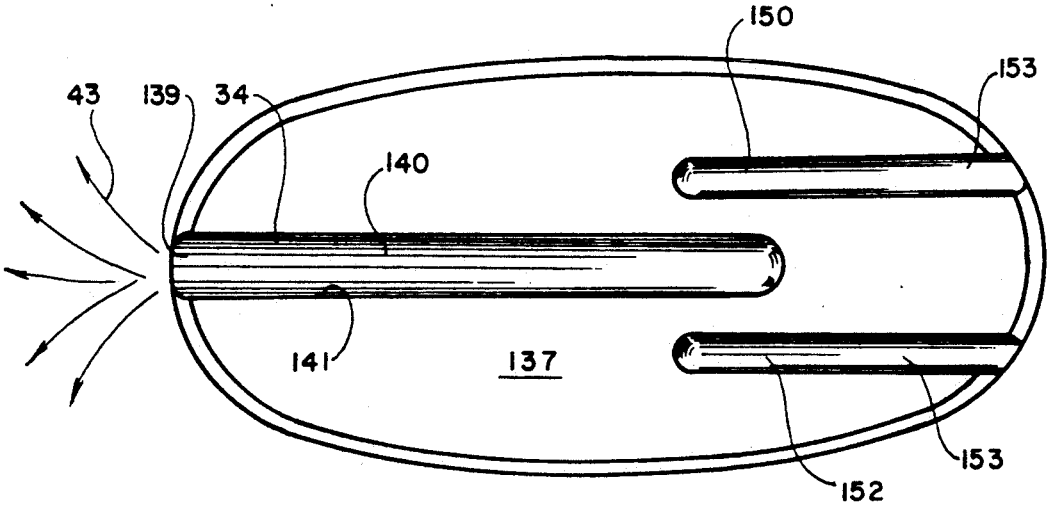
FIG. 12 is a plan view of an alternative embodiment of a sole of the footwear in accordance with the present invention.

Further, as illustrated in FIG. 12, under surface layer 135 includes a centrally located channel 140, extending from substantially $\frac{1}{3}$ of the undersurface 137 of under layer 135, and extends rearwardly along the rear $\frac{2}{3}$ length of the undersurface 135, with arcuate opening 139 at the very rear end of the platform. Channel 140 has a curved continuous wall 141 formed in undersurface 135, and serves as a means for allowing water which would be under high pressure as it impacts the forward portion 138 of underside 135 to release into channel 140, and to be discharged from channel 140 in the direction of lines 43 as illustrated in FIG. 11. This channel 140 serves as a means to provide greater maneuverability of the footwear 10 during use, and helps the platform to glide more easily and safely along the water.

Figure 9:
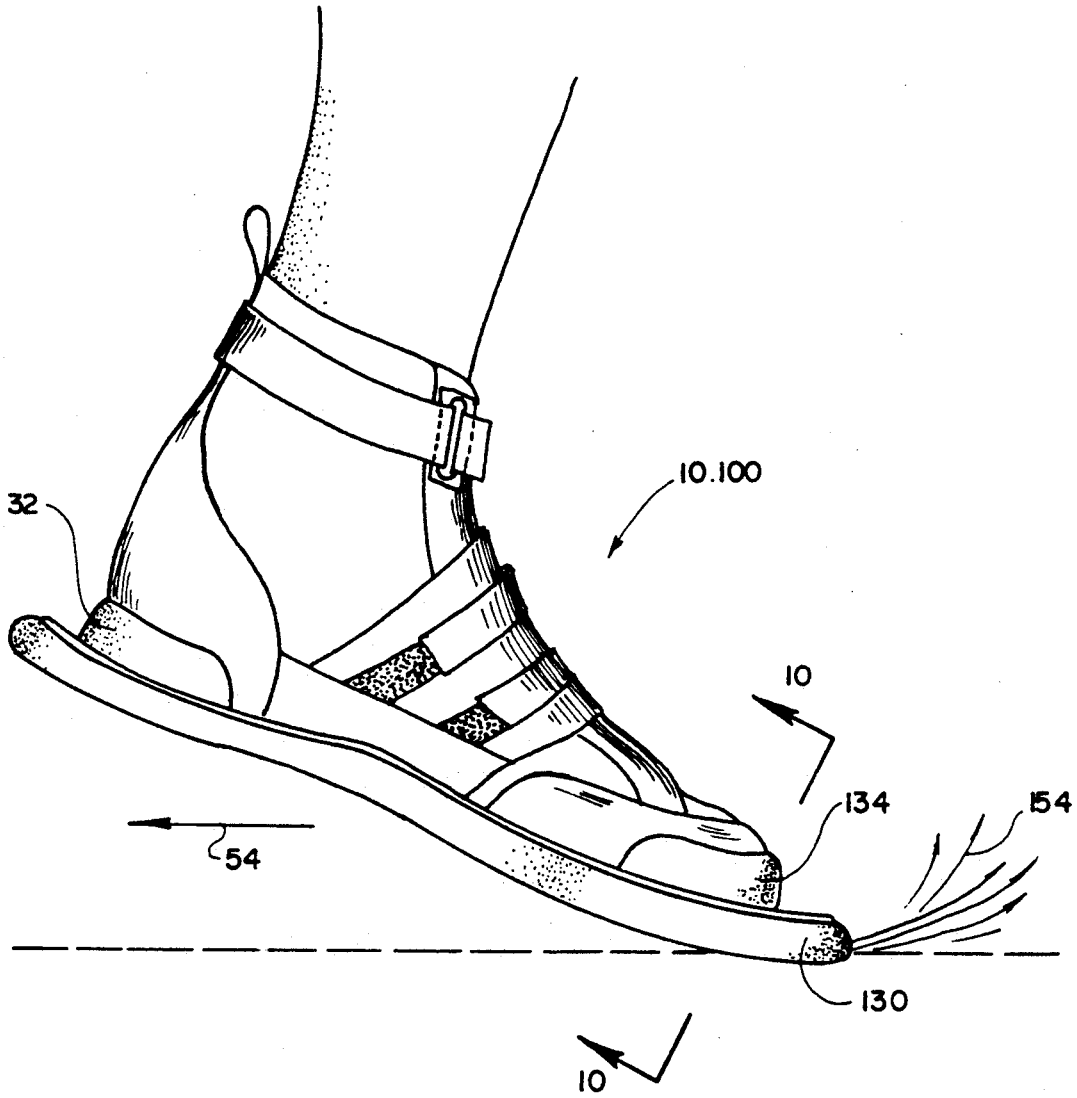
FIG. 9 is a side view illustrating the water sport footwear of the second embodiment in use.

As further illustrated in FIGS. 12, an alternate embodiment of the shoe sole is illustrated having an additional pair of channel members 150 and 152, each channel 150 and 152 carved into the undersurface 135 of shoe 100, and again forming a channel having an arcuate upper wall 153, and extending along substantially the forward front third of the shoe surface 135, and somewhat overlapping in distance the primary channel 34 as illustrated in FIG. 4. The pair of secondary channels 150 and 152 further defining a means for providing ingress and egress of the pressurized water upon which ski shoe 100 is gliding while the footwear is being utilized in a manner as illustrated in FIG. 9, wherein the skier is moving in a backwards mode. A pair of channels 150 and 152 would allow again greater maneuverability and stability to the user as the footwear 10 is moving in the direction of Arrow 54 as illustrated in FIG. 9.

Due to the unique construction of the composite shoe 10 and 100 in having the rigid upper platform 130 secured to the upper shoe 14, 120, and the lower softer, ski plaining portion 135 making contact with the water, the lower portion 135 is able to absorb greater impact with the water, and yet serve as a means, with the utilization of border 137 to protect direct impact to the upper portion 130 during use of the water sport footwear. Therefore, the user is provided with greater stability and safety during use.

Many other modifications can be made in the present invention, without departing from the spirit and scope thereof. We, therefore, pray that our rights to the present invention be limited only by the scope of the appended claims.

We claim:

1. A composite water sport footwear, comprising:

an upper shoe portion, for accommodating a foot of a wearer;

a lower platform portion secured to the foot portion along entire length of the shoe portion, the platform portion further comprising:

an upper rigid support surface defining a means for permanently attaching the shoe portion thereinto;

a bottom sole portion secured along entire length of the upper support surface, further defining a somewhat softer impactable surface, for gliding along water surface during use; and a channel means formed in a lower surface of the bottom sole portion, for allowing water to flow therewithin and be delivered rearward of the shoe, for added stability and maneuverability during use, and wherein a pair of additional water channels are formed in the bottom sole portion extending from a front edge of the bottom sole portion to a point substantially $\frac{1}{3}$ of the length of the bottom sole portion, for defining a means for allowing water to flow therethrough and be delivered to the front of the shoe, for added stability and maneuverability, while the user is moving backwards on water.

* * * * *